US006019533A

United States Patent [19]

Smith

[11] Patent Number: 6,019,533

[45] Date of Patent: Feb. 1, 2000

[54] GRIP ACCESSORY, WRITING INSTRUMENT AND A METHOD FOR ENHANCING COMFORT IN A GRIPPED SURFACE

[75] Inventor: Paul A. Smith, Glenview, Ill.

[73] Assignee: Eversharp Pen Co., Franklin Park, Ill.

[21] Appl. No.: 09/124,959

[22] Filed: Jul. 29, 1998

Related U.S. Application Data

[63] Continuation-in-part of application No. 08/912,334, Aug. 18, 1997.

[51] Int. Cl.[7] ..... A46B 5/02

[52] U.S. Cl. ..... 401/6; 401/88; 15/443; 604/265

[58] Field of Search ..... 401/6, 88; 138/138, 138/112, 113, 114; 16/110 R, 111 R; 15/443; 604/905, 265; 424/405

[56] References Cited

U.S. PATENT DOCUMENTS

| | | | |
|---|---|---|---|
| D. 27,737 | 10/1897 | Meloche . | |
| D. 206,896 | 2/1967 | Fiely . | |
| D. 286,650 | 11/1986 | Fischer . | |
| D. 328,920 | 8/1992 | Kimball . | |
| D. 333,676 | 3/1993 | Bedol . | |
| D. 342,968 | 1/1994 | Meinke . | |
| D. 342,969 | 1/1994 | Edwards . | |
| 426,324 | 4/1890 | Ramsey . | |
| 768,985 | 8/1904 | Goldsmith | 401/6 |
| 782,388 | 2/1905 | Goldsmith . | |
| 967,410 | 8/1910 | Montgomery . | |
| 1,206,976 | 12/1916 | Barth . | |
| 2,273,044 | 2/1942 | Johnson . | |
| 2,292,324 | 8/1942 | Llawrence . | |
| 4,147,443 | 4/1979 | Skobel . | |
| 4,148,424 | 4/1979 | Fortenberry . | |
| 4,202,088 | 5/1980 | Hansen . | |
| 4,602,885 | 7/1986 | Bischoff et al. . | |
| 4,733,808 | 3/1988 | Turner, Jr. et al. . | |
| 4,738,556 | 4/1988 | Brown . | |
| 4,778,447 | 10/1988 | Velde et al. . | |
| 4,925,668 | 5/1990 | Khan et al. | 424/422 |
| 4,932,800 | 6/1990 | Lin et al. . | |
| 4,934,024 | 6/1990 | Sexton, I . | |
| 5,000,599 | 3/1991 | McCall et al. | 401/6 |
| 5,267,945 | 12/1993 | Doctor et al. . | |
| 5,882,667 | 3/1999 | Jones | 424/405 |

FOREIGN PATENT DOCUMENTS

| | | |
|---|---|---|
| 2 157 175 | 5/1973 | Germany . |

*Primary Examiner*—David J. Walczak
*Assistant Examiner*—Huyen Le
*Attorney, Agent, or Firm*—Brian M. Mattson; Patents+TMS, P.C.

[57] ABSTRACT

A sleeve is provided for attachment to a device to provide added comfort when gripping the device. The sleeve is constructed from a rubberized silicone and is extruded in its manufacture. The sleeve is formed with a substantially uniform outer diameter dimension and an inner diameter that varies between a first smaller diameter and a larger diameter. The diameters of the inside of the sleeve alternate around a periphery of the sleeve forming fingers. As a result, pressure applied to the exterior of the sleeve forms the sleeve to give or release, hence providing additional gripping comfort.

11 Claims, 2 Drawing Sheets

GRIP ACCESSORY, WRITING INSTRUMENT AND A METHOD FOR ENHANCING COMFORT IN A GRIPPED SURFACE

BACKGROUND OF THE INVENTION

This application is a continuation-in-part of co-pending U.S. patent application Ser. No. 08/912,334 filed Aug. 18, 1997.

The present invention generally relates to a sleeve or grip accessory. More specifically, the present invention relates to a sleeve extruded from a material that provides comfort during use of a device fitted with the sleeve. Still further, the present invention relates to a writing instrument, such as a pen or the like, fitted with a sleeve, as well as a method for enhancing comfort in a gripped surface. Moreover, the present invention provides a sleeve or grip accessory that has anti-bacterial properties.

It is, of course, generally known to provide a writing instrument, such as a pen or pencil, or the like, and design the same such that the writing instrument is comfortable to hold. Of course, many instruments are difficult and/or uncomfortable to hold and, during use of the same, users often experience the development of calluses or like friction points on hands or fingers of the user, particularly those fingers which grip the writing instrument. Further, often handicaps or other difficulties arise with certain individuals making it difficult or uncomfortable to hold or grip a writing instrument.

Recently, gripping devices that may be added to a writing instrument have been developed for securing around a shaft of the writing instrument. However, the known gripping devices, although they may relieve certain discomforts from pressure applied to a writing instrument, do not adequately respond to various amounts of pressure applied during implementation and use of the writing instrument. Therefore, although the known devices may cause initial comfort during use, the known devices are not responsive to varying pressure points in both amount and location when used with writing instruments or other structures. Further, the known devices do not have adequate material properties to withstand the varying conditions that the instrument on which the device is used may be subjected.

Still further, no devices are known that provide an actively sterile surface that kills bacteria upon contact while also preventing build-up of undesired matter.

A need, therefore, exists for an improved gripping device and writing instrument incorporating the same to overcome the problems associated with known writing instruments and gripping devices used therewith as well as a method for enhancing comfort in a gripped surface.

SUMMARY OF THE INVENTION

The present invention provides a sleeve, a writing instrument, and a method for increasing comfort in a gripped surface. More specifically, the present invention provides a sleeve, a writing instrument and a method for improving comfort that provides a surface that gives to pressure applied thereto during use of the device.

In an embodiment of the present invention, a sleeve is provided. The sleeve has a tube having a length defined between a first end and a second end wherein the tube includes a uniform outer diameter and two defined inner diameters wherein a first inner diameter is smaller than a second inner diameter and further wherein the first and second inner diameters alternate around an inner periphery of the tube forming fingers. The tube is constructed of rubberized silicone and further includes an anti-bacterial coating.

In an embodiment, the tube is extruded.

In an embodiment, at least four fingers are formed around the inner periphery.

In an embodiment, only eight fingers are formed around the inner periphery.

In an embodiment, each of the fingers is uniformly dimensioned.

In an embodiment, the length of the sleeve is no greater than two inches.

In an embodiment, the fingers extend uniformly along the inner periphery between the first end and the second end.

In another embodiment of the present invention, a writing instrument is provided. The writing instrument has a shaft having a diameter and a length defined between a first end and a second end. A writing medium at the first end of the shaft is capable of transcribing information as directed by a user. A sleeve has a length less than the length of the shaft wherein the sleeve has a uniform exterior diameter and two defined inner diameters wherein a first inner diameter is smaller than a second inner diameter and further wherein the first inner diameter is substantially equal to the diameter of the shaft such that the first inner diameter grips the shaft and still further wherein the first and second inner diameters alternate around an inner periphery of the tube forming fingers. The sleeve is constructed of rubberized silicone and further includes an anti-bacterial coating.

In an embodiment, the fingers extend uniformly along the inner periphery between the first end and the second end.

In an embodiment, the sleeve is extruded.

In an embodiment, at least four fingers are formed around the inner periphery.

In an embodiment, only eight fingers are formed around the inner periphery.

In another embodiment of the present invention, a method is provided for increasing comfort in a gripped surface. The method comprises the steps of: providing a sleeve that includes a uniform outer diameter and two defined inner diameters wherein a first inner diameter is smaller than a second inner diameter and further wherein the first and second inner diameters alternate around an inner periphery of the tube forming fingers; and securing the sleeve to a shaft of a device wherein the sleeve is constructed from a rubberized silicone and further includes an anti-bacterial coating.

In an embodiment, the device is a writing instrument.

In another embodiment of the present invention a sleeve is provided. The sleeve has a tube having a length defined between a first end and a second end wherein the tube includes an inner uniform diameter and an outer uniform diameter concentrically formed with each other wherein the inner diameter is smaller than the outer diameter and still further wherein a first plurality of walls extends between the inner diameter and the outer diameter forming compartments that extend along the length of the tube.

In an embodiment, the compartments are non-uniformly spaced around a periphery of the sleeve.

In an embodiment, a second plurality of walls connects adjacent walls of the first plurality of walls.

In an embodiment, the second plurality of walls are randomly spaced between the inner wall and the outer wall.

In an embodiment, an anti-bacterial coating is provided on the outer wall of the tube.

In another embodiment of the present invention, a writing instrument is provided. The writing instrument has a shaft having a diameter and a length defined between a first end and a second end; a writing tip at the first end of the shaft; and a sleeve having a length less than the length of the shaft wherein the sleeve includes an inner uniform diameter and an outer uniform diameter concentrically formed with each other wherein the inner diameter is smaller that the outer diameter and still further wherein a first plurality of walls extends between the inner diameter and the outer diameter forming compartments that extend along the length of the sleeve.

In an embodiment, a second plurality of walls connects adjacent walls of the first plurality of walls.

In an embodiment, an anti-bacterial coating is provided on the outer wall of the sleeve.

In another embodiment of the present invention, a sleeve is provided. The sleeve has a tube having a length defined between a first end and a second end wherein the tube includes an inner diameter and an outer diameter wherein the inner diameter is smaller than the outer diameter; and an anti-bacterial coating deposited on the outer wall of the tube.

In an embodiment, the anti-bacterial coating covers the outer diameter of the tube.

It is, therefore, an advantage of the present invention to provide a sleeve, a writing instrument and a method for increasing comfort in a gripped surface that is simple to manufacture.

Another advantage of the present invention is to provide a sleeve, a writing instrument and a method for increasing comfort in a gripped surface that is inexpensive.

Yet another advantage of the present invention is to provide a sleeve, a writing instrument and a method for increasing comfort in a gripped surface that is simple to implement on various devices.

Moreover, an advantage of the present invention is to provide a sleeve, a writing instrument and a method for increasing comfort in a gripped surface that reduces pressure points on, for example, a user's hands.

A still further advantage of the present invention is to provide a sleeve, a writing instrument and a method for increasing comfort in a gripped surface that provides comfort during use over extended periods of time.

And, another advantage of the present invention is to provide a sleeve, a writing instrument and a method for increasing comfort in a gripped surface using a durable device that can be subjected to various extreme conditions.

A further advantage of the present invention is to provide a sleeve, a writing instrument and a method for increasing comfort in a gripped surface that gives to varying amounts or pressure at distinct locations.

Moreover, an advantage of the present invention is to provide a sleeve, a writing interest and a method for increasing comfort in a gripped surface that includes an anti-bacterial agent.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides a sleeve that, when implemented on a device, increases comfort in a gripping surface of a user. The present invention further relates to a writing instrument on which a sleeve of the present invention may be implemented. Still further, the present invention relates to a sleeve including an anti-bacterial agent associated therewith.

Figure 3:
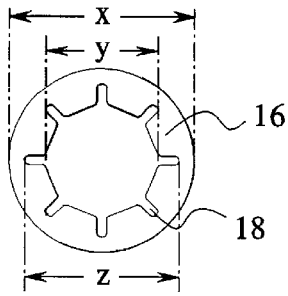
FIG. 3 illustrates an end view of an embodiment of a sleeve of the present invention.
Figure 1:
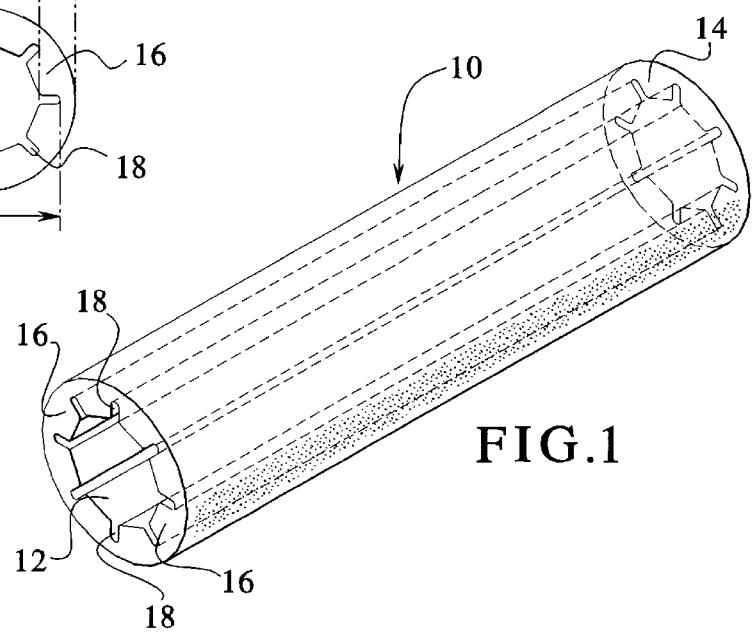
FIG. 1 illustrates a perspective view of an embodiment of a sleeve of the present invention.
Figure 2:
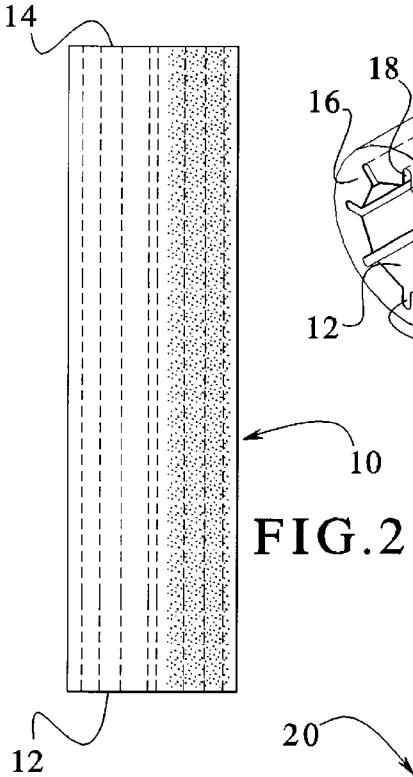
FIG. 2 illustrates a side view of an embodiment of a sleeve of the present invention.

Referring now to the drawings wherein like numerals refer to like parts, FIG. 1 generally illustrates a sleeve 10 having a first end 12 and a second end 14 that define a length of the sleeve 10 therebetween. As shown in FIG. 3, the sleeve 10 has a substantially uniform exterior diameter x and a first interior diameter y and a second interior diameter z. The first smaller diameter defined by y and the second larger diameter defined by z alternate around a periphery of an interior of the sleeve forming fingers 16. As illustrated in FIGS. 1 and 3, eight fingers 16 are formed around an interior periphery of the sleeve 10. Accordingly, a recessed area 18 is also formed in the inner periphery of the sleeve 10. The recessed areas 18 may be substantially equally spaced around the inner periphery; in that case, the fingers 16 are of substantially equal size.

In a preferred embodiment, the fingers 16 extend along an entire length of the sleeve 10 between the first end 12 and the second end 14 as illustrated in phantom in FIG. 1 as well as the side view in FIG. 3.

Preferably, the sleeve 10 of the present invention is formed from rubberized silicone and, therefore, has a semi-pliant surface that is somewhat resilient to touch and to pressure applied to the exterior surface. Such a material provides properties not previously available for such an application and further provides, in its unique construction, the ability to apply varying amounts of pressure at various locations and adequately respond to the same to maintain comfort during use. Further, the material has a long life and is both heat and cold resistant, i.e. not affected by temperature within a range of −120° F. to 400° F. The material does not stain, corrode or deteriorate including any effect as a result of contact with other materials. The material is also non-toxic and tear resistant.

Preferably, the sleeve 10 is formed by an extrusion process that creates the recesses 18 and the fingers 16 during manufacture of the sleeve 10. Of course, other materials may be implemented by those skilled in the art. Preferably, materials having similar pliancy properties may be implemented.

Figure 4:
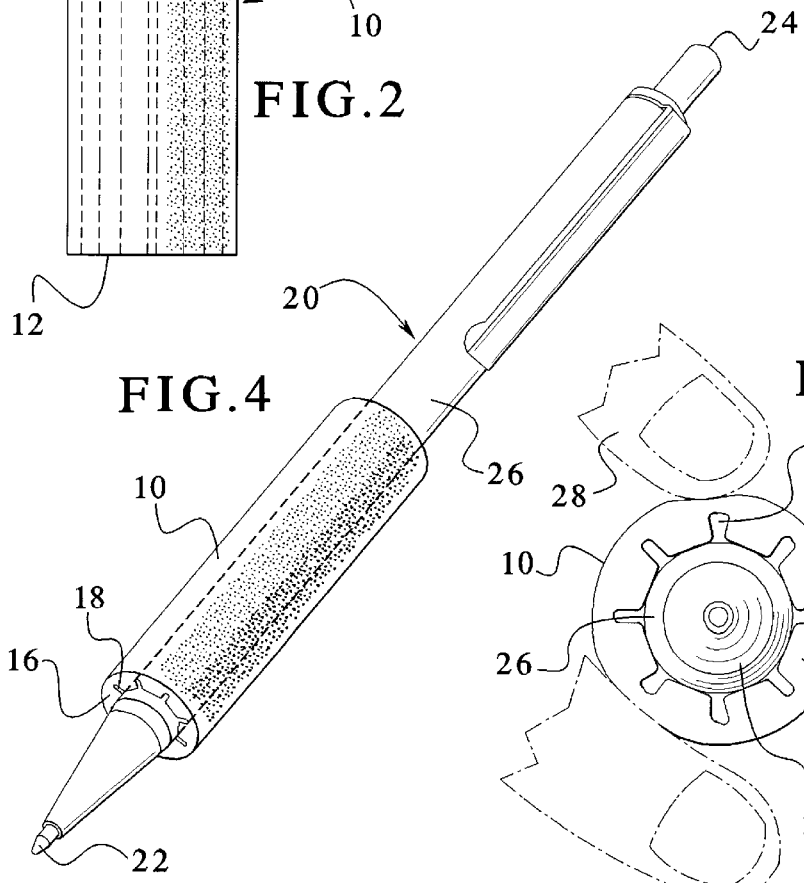
FIG. 4 illustrates a perspective view of an embodiment of a writing instrument on which a sleeve of the present invention is implemented.

FIG. 4 illustrates a writing instrument 20, in this case, a pen. The writing instrument 20 includes an end with a writing tip 22 and an opposite end 24. The writing instrument 20 has the sleeve 10 of the present invention secured around a shaft 26 of the writing instrument 20.

As illustrated, the exterior diameter of the shaft 26 is substantially equal in diameter to the smaller diameter defined by y in FIG. 3 of the sleeve 10 such that the sleeve 10 secures onto the shaft 26 of the writing instrument 20 and, therefore, removal or rotation of the sleeve 10 may be difficult. The sleeve 10 may be integrally formed with the shaft 26 as well.

As illustrated in FIG. 4, the sleeve 10 is approximately two inches in length; of course, other sizes may be implemented by those skilled in the art and may, as well, be application dependent or further depend on the needs of the user of the particular device on which the sleeve 10 is implemented.

Figure 5:
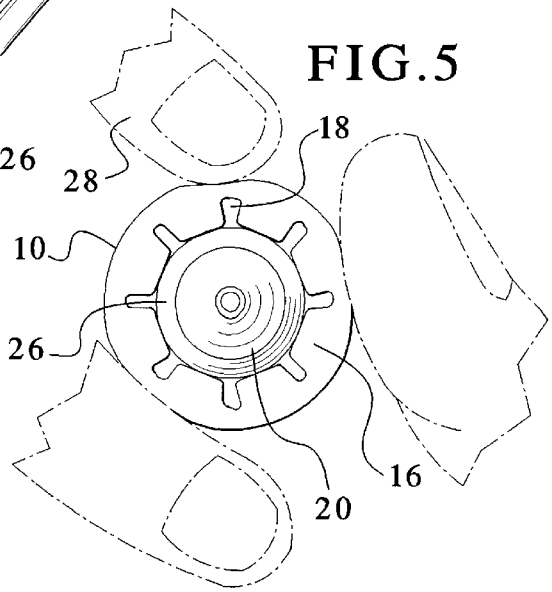
FIG. 5 illustrates an end view of an embodiment showing use of the sleeve of the present invention by an individual on a writing instrument.

As shown in FIG. 5, a user is gripping the sleeve 10 having the writing instrument 20 therein. As shown, the sleeve 10 compresses from forces applied to an exterior surface thereof. As a result, "give" or "release" of the sleeve 10 on an exterior shaft of, for example, the writing instrument 20, is most clearly shown by the variation in the recess 18 shown in FIG. 5. At that point, a finger 28 of a user is applying pressure to an exterior surface of the sleeve 10 which is mounted on, for example, a shaft 26 of the pen 20. As a result, added comfort and more give are provided from pressure applied by the fingers 28 of the user due to the recesses 18 formed between adjacent fingers 16 in the interior of the sleeve 10.

Although the present invention has been described with reference to use with a writing instrument, such as a pen, it should be understood that the sleeve 10 may be implemented on any type of device that requires manipulation of, for example, a handle. Such devices include, but are not limited to, tools, scissors, steering wheels, vacuums, or the like. Of course, as previously mentioned, the sleeve may be altered in any dimension in order to fit the specific application for use of the sleeve.

Figure 6:
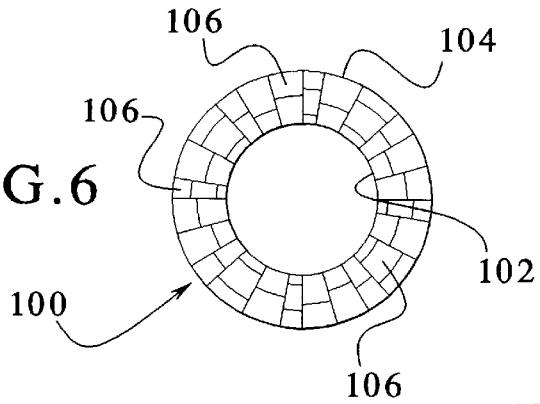
FIG. 6 illustrates a cross-sectional view of another embodiment of a sleeve of the present invention.

Another embodiment of the present invention is shown and described with reference to FIGS. 6–8. In FIG. 6, a sleeve 100 is generally illustrated in crosssectional view. The sleeve 100 has a honeycomb configuration between its inner wall 102 and its outer wall 104. In essence, randomly spaced compartments 106 are formed along the length of the sleeve 100 wherein each of the compartments 106 individually has a substantially uniform cross-section continuously along a length of the sleeve 100. The compartments 106 are formed by walls 112, 114 formed between the inner wall 102 and the outer wall 104. The walls 112,114 are substantially perpendicular to one another, but any configuration of the walls 112,114 may be implemented by one having ordinary skill in the art in order to form the compartments 106 or other sized or shaped compartments. Preferably, however, at least two or three rows of compartments are formed radially from the inner wall 102 to the outer wall 104.

Figure 8:
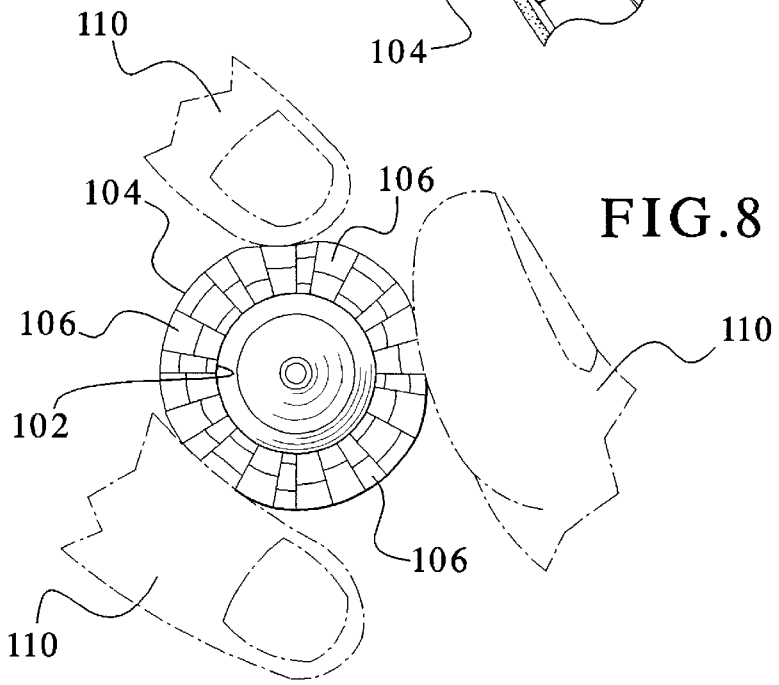
FIG. 8 illustrates an end view of an embodiment of the sleeve shown in FIG. 6 during use of the sleeve on a writing instrument by an individual.

The configuration for the sleeve 100 has been found to be particularly advantageous in use as illustrated in FIG. 8 as the random spacing of compartments 106 in a honeycomb configuration allows variable release of the outer wall 104 of the sleeve 100 about its periphery. As a result, additional comfort due to the release provided by the outer wall 104 of the sleeve 100 due to the honeycomb configuration of the compartments 106 is experienced by a user.

Figure 7:
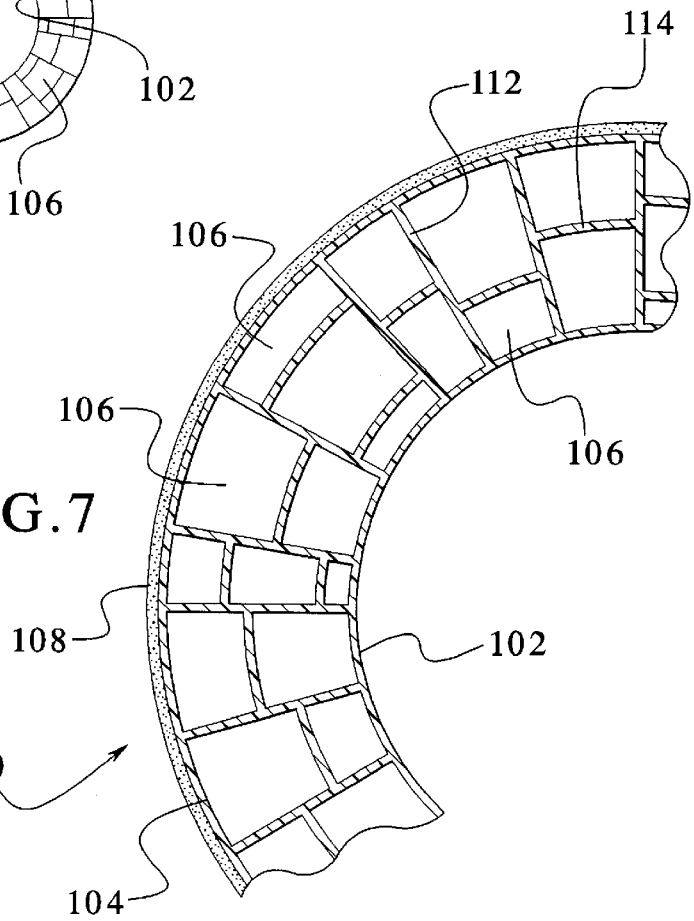
FIG. 7 illustrates an exploded cross-sectional view of yet another embodiment of a sleeve of the present invention including an anti-bacterial agent.

FIG. 7 illustrates an alternate embodiment of the sleeve generally shown with reference to FIG. 6. In FIG. 7, an additional layer or coating 108 is shown that acts as an anti-bacterial coating for the exterior wall 104 of the sleeve 100. While the anti-bacterial coating 108 is shown in FIG. 7 with reference to the embodiment illustrated in FIG. 6, it should be appreciated that the coating 108 may be implemented to any type of sleeve including the embodiment illustrated and shown with reference to FIGS. 1–5.

The anti-bacterial coating 108 produces an actively sterile surface that kills bacteria upon contact, such as the contact by fingers 110 of an individual during use of the sleeve 100 with, for example, a writing instrument, such as a pen. One known material that may be implemented as a coating to the sleeve of the present invention is SPI-ARGENT™ manufactured by Spire, Inc. The material may be incorporated via deposition technology, namely ion-beam assisted deposition (IBAD) to create an infection-resistant, actively sterile coating. IBAD is coating technology that combines physical vapor deposition (PVD) with ion-beam bombardment in a high vacuum environment. Of course, other means may be implemented to apply the coating 108 to the sleeve 100 of the present invention. The coating 108 is bactericidal on contact and effective for prolonged periods of time and retains its bactericidal properties. The coating 108 creates a surface that kills, on contact, bacterial and fungal strains.

As a result, during use of the sleeve 100, bacteria is killed and remains effective to be killed during use of the device. This can be particularly beneficial in, for example, hospital settings, nursing homes, or the like where use of a writing instrument is repeated by many different individuals and the sterility of that instrument is of vital importance. Use of the coating 108 results in a reduction of nearly 100 percent of bacteria formed on the sleeve 100. In addition, bacterial attachment is virtually eliminated. In addition, the coating 108 is biocompatible and, therefore, no difference exists between a treated surface and a nontreated surface of the sleeve 100 or the sleeve 10 shown with reference to FIG. 1. Therefore, the coating 108 is critical to the present invention in its application to a sleeve or a writing instrument. And, this use has never been contemplated in conjunction with a writing instrument or sleeve for use therewith or for other applications of a sleeve required for use in a sterile environment or the like.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A sleeve comprising:

a tube having a length defined between a first end and a second end wherein the tube includes an inner uniform diameter and an outer uniform diameter concentrically formed with each other wherein the inner diameter is smaller than the outer diameter and still further wherein a first plurality of walls extends between the inner diameter and the outer diameter forming randomly spaced compartments that extend along the length of the tube.

2. The sleeve of claim 1 wherein the compartments are non-uniformly spaced around a periphery of the sleeve.

3. The sleeve of claim 1 further comprising:

a second plurality of walls connecting adjacent walls of the first plurality of walls.

4. The sleeve of claim 3 wherein the second plurality of walls are randomly spaced between the inner wall and the outer wall.

5. The sleeve of claim 1 further comprising:

an anti-bacterial coating on the outer wall of the tube.

6. A writing instrument comprising:

a shaft having a diameter and a length defined between a first end and a second end;

a writing tip at the first end of the shaft; and a sleeve having a length less than the length of the shaft wherein the sleeve includes an inner uniform diameter and an outer uniform diameter concentrically formed with each other wherein the inner diameter is smaller that the outer diameter and still further wherein a first plurality of walls extends between the inner diameter and the outer diameter forming randomly spaced compartments that extend along the length of the sleeve.

7. The writing instrument of claim 6 further comprising:

a second plurality of walls connecting adjacent walls of the first plurality of walls.

8. The writing instrument of claim 6 further comprising:

an anti-bacterial coating on the outer wall of the sleeve.

9. A sleeve comprising:

a tube having a length defined between a first end and a second end wherein the tube includes an inner uniform diameter and an outer uniform diameter concentrically formed with each other wherein the inner diameter is smaller than the outer diameter and still further wherein a first plurality of walls extends between the inner diameter and the outer diameter forming compartments that extend along the length of the tube wherein a second plurality of walls are randomly spaced between the inner wall and the outer wall.

10. A sleeve comprising:

tube having a length defined between a first end and a second end wherein the tube includes an inner uniform diameter and an outer uniform diameter concentrically formed with each other wherein the inner diameter is smaller than the outer diameter and still further wherein a first plurality of walls extends between the inner diameter and the outer diameter forming randomly spaced compartments that extend along the length of the tube; and an anti-bacterial coating on the outer wall of the tube.

11. A writing instrument comprising:

a shaft having a diameter and a length defined between a first end and a second end;

a writing tip at the first end of the shaft;

a sleeve having a length less than the length of the shaft wherein the sleeve includes an inner uniform diameter and an outer uniform diameter concentrically formed with each other wherein the inner diameter is smaller that the outer diameter and still further wherein a first plurality of walls extends between the inner diameter and the outer diameter forming randomly spaced compartments that extend along the length of the sleeve; and an anti-bacterial coating on the outer wall of the sleeve.

* * * * *